US007308779B2

(12) United States Patent
Benz

(10) Patent No.: US 7,308,779 B2
(45) Date of Patent: Dec. 18, 2007

(54) METHOD AND DEVICE FOR PACKING TUBES

(75) Inventor: Gottlieb Benz, Flums (CH)

(73) Assignee: Texa AG, Haldenstein (CH)

( * ) Notice: Subject to any disclaimer, the term of this patent is extended or adjusted under 35 U.S.C. 154(b) by 0 days.

(21) Appl. No.: 10/567,526

(22) PCT Filed: Aug. 12, 2004

(86) PCT No.: PCT/CH2004/000503

§ 371 (c)(1),
(2), (4) Date: Feb. 7, 2006

(87) PCT Pub. No.: WO2005/019035

PCT Pub. Date: Mar. 3, 2005

(65) Prior Publication Data

US 2006/0191238 A1 Aug. 31, 2006

(30) Foreign Application Priority Data

Aug. 20, 2003 (CH) ..... 1418/03

(51) Int. Cl.
*B65B 35/30* (2006.01)

(52) U.S. Cl. ..... 53/147; 53/148; 53/247; 414/416.09

(58) Field of Classification Search ..... 53/443–444, 53/147–149, 473, 246–248; 414/751–752.1, 414/776, 910, 749.1, 749.2, 567–568, 416.09
See application file for complete search history.

(56) References Cited

U.S. PATENT DOCUMENTS 2,778,476 A * 1/1957 Engleson et al. ..... 53/436
3,040,491 A * 6/1962 Viitanen ..... 53/443
3,365,857 A * 1/1968 Liedtke ..... 53/148
3,542,221 A * 11/1970 Inata et al. ..... 414/567
3,848,496 A * 11/1974 Stevens et al. ..... 83/133
4,277,994 A * 7/1981 Gargrave ..... 83/133
4,343,585 A * 8/1982 Tedeschi ..... 414/403
4,449,599 A * 5/1984 Creek ..... 180/8.1
4,627,215 A * 12/1986 Walz ..... 53/246

(Continued)

FOREIGN PATENT DOCUMENTS

DE 3631891 A1 * 3/1987

(Continued)

*Primary Examiner*—Rinaldi I. Rada
*Assistant Examiner*—Lindsay Low
(74) *Attorney, Agent, or Firm*—Weingarten, Schurgin, Gagnebin & Lebovici LLP

(57) ABSTRACT

Tubes (T), coming from a production line, are supplied by means of a grouping unit (1). The grouping unit comprises a conveyor belt (10), with product holders (11) and the tubes are supplied in groups by means of a stepping motor (12). A slider (13) pushes the tubes (T) into the correct position on a mandrel support (20) of a packaging unit (2). The mandrel support (20) comprises a plate (21), which may be moved back and forth by means of a piston/cylinder unit (22) and which may be pivoted from the horizontal holding position into the vertical dispensing position. The tubes are pushed onto mandrels (25) which are mounted on the plate (21), by means of the slider (13), The tubes are thus held in exact alignment and can be filled into the carton (B) without a relative displacement or tilting of the tubes.

8 Claims, 5 Drawing Sheets

U.S. PATENT DOCUMENTS 4,773,810 A * 9/1988 Nishimura et al. .... 414/331.11
5,060,454 A 10/1991 Benz
5,136,826 A * 8/1992 Carson et al. ..... 53/443
5,310,300 A * 5/1994 Crabb et al. ..... 414/280
5,471,738 A * 12/1995 Burcham et al. ..... 29/701
5,524,416 A * 6/1996 Linner ..... 53/251
5,611,193 A * 3/1997 Farrelly ..... 53/475
5,934,859 A * 8/1999 Goetzelmann ..... 414/416.08
6,062,845 A * 5/2000 Conaway et al. ..... 425/444
6,733,224 B1 * 5/2004 Linner ..... 414/416.02

FOREIGN PATENT DOCUMENTS

GB 2137583 A * 10/1984
JP 01 099912 4/1989
JP 07 010126 1/1995

* cited by examiner

METHOD AND DEVICE FOR PACKING TUBES

This application is a 371 national phase filing of PCT/CH2004/000503 filed Aug. 12, 2004, and claims priority to a Swiss application No. 1418/03 filed Aug. 20, 2003.

BACKGROUND OF THE INVENTION

The present invention relates to a method and to a device for packing tubes which arrive continuously from a production line and by way of a grouping unit are arranged in groups of tubes lying next to one another with a settable unit number of tubes, which correspond to a layer of tubes to be deposited in a box.

Methods and devices which serve for grouping production units and packing them in boxes are known in many embodiments. The procedure with regard to the method as well as a suitable device in order to carry out such a method are in each case very dependent on the type of production units. Thus for example U.S. Pat. No. 5,732,536 shows a device by way of which adhesive tapes may be packed into boxes, the German published patent application DE-A-22 00 390 a device for packing for example household paper rolls, or EP-0 360 310 a device for packing flower pots. The handling of the most varied types of products accordingly necessitates various types of methods and devices, and even with products which appear to be of the same type, various problems may arise depending on the size or the design shape, and these problems demand differently adapted methods and devices.

The present invention relates to the packing of tubes. Here, one proceeds from a known device for forming product groups, as is for example known from EP-B-1 114 784. This device is in particular used for forming groups of elongate, cylindrical product units, such as sleeves of tubes or tins which arrive continuously from a production line, and are used for forming product groups with a preselectable unit number. The formed product groups on a conveying transport belt are brought into a push-off position and from there are pushed into a box in a layered manner. Devices of this type have proven to be extremely successful on the market, and operate with extraordinarily high cycle times. These machines have also been applied for packing tubes. If they are tubes of metal, then the tube body is relatively heavy with respect to the tube head, and the filling into the boxes is accordingly effected without any problem. The situation with tubes of plastic or laminates is more difficult. The ratio of the weight of the head of the tube to the weight of the body of the tube changes depending on the size of the tube. This is particularly the case with middle to small tube sizes. The ratio is additionally unfavorably influenced since the plastic tubes from the production lines are already delivered with the tube cap placed on, since these tubes in the delivered form after packing, are supplied to the respective firms for filling the tubes. Accordingly, the heads of the tubes which are thus delivered are almost always heavier that the sleeve-like tube body.

With all machines which are present on the market today, the tubes are pushed into a suitable box in a layered manner, wherein this box stands or lies on a side wall and accordingly the tubes are pushed into the box in a roughly horizontal direction. If then the tube heads are heavier than the sleeves, then the tubes which are already deposited in the box tend to tilt, so that the open sleeves directed to the grouping unit project slightly upwards beyond the actual plane which corresponds to the respective layer. The result of this is that subsequent layers abut such projecting tubes on insertion, and accordingly a disarrangement occurs, which leads to an immediate interruption of the method. This is extremely annoying, since these packing machines are mostly directly at the end of the respective production lines and thus an interruption on packing leads to an interruption of production too. As already mentioned, these problems are aggravated due to the fact that the respective closures have already been placed on the tube heads, and these closures furthermore have a smaller diameter than the sleeve itself. This encourages the previously described tilting movement.

A further problem lies in the fact that such plastic tubes and in particular plastic tubes of smaller dimensions very often serve for packing pharmaceutical products with which particular strict cleanliness rules exist. Accordingly, the packing machines described here, just as the production machines themselves are located in suitable clean rooms. This means that the tubes must either be packed in plastic boxes or one must use suitable plastic boxes which need to be lined with bag-like plastic film. Plastic tubes themselves as well as plastic boxes or the bag-like plastic film linings all tend to statically charge, by which means forces may occur by way of the static charging, even without the described tilting effect, which may lead to dislocations of the grouped units.

BRIEF SUMMARY OF THE INVENTION

It is the object of the present invention to provide a method with which in particular tubes of plastic or of laminates may also be filled in plastic boxes or in cardboard boxes with a bag-like plastic lining, without the previously mentioned problems being capable of arising.

A method and device for packing tubes that arrive continuously from a production line are disclosed. More particularly, tubes arriving in a grouping unit are arranged in groups of tubes lying next to one another. A first group of tubes is pushed on a first, uppermost row of mandrels that are arranged on a plate-like mandrel support. The plate-like mandrel support has the dimensions of the clear opening of the box to be filled.

Once the mandrel support is pushed and the first group of tubes are pushed onto the first, uppermost row of mandrels, the mandrel support is lifted and is traveled away from the grouping unit, whereupon the next group of tubes is formed and the mandrel support is again moved to the grouping unit. Then a second group of tubes is pushed onto a second mandrel row immediately below the first, uppermost row of mandrels. This procedure is repeated until all mandrels of the mandrel support are occupied with tubes.

The mandrel support can then be pivoted and moved into an open box where the tubes are pushed off from all mandrels simultaneously into the box, whereupon the mandrel support travels back to its original position and is ready for the next loading.

BRIEF DESCRIPTION OF THE DRAWINGS

The essential features of the device according to the invention are represented in the accompanying drawing, and these just as the method are described hereinafter with reference to the accompanying drawings. There are shown in:

FIG. 6 the same in section, as well as

DETAILED DESCRIPTION OF THE INVENTION

Figure 1:
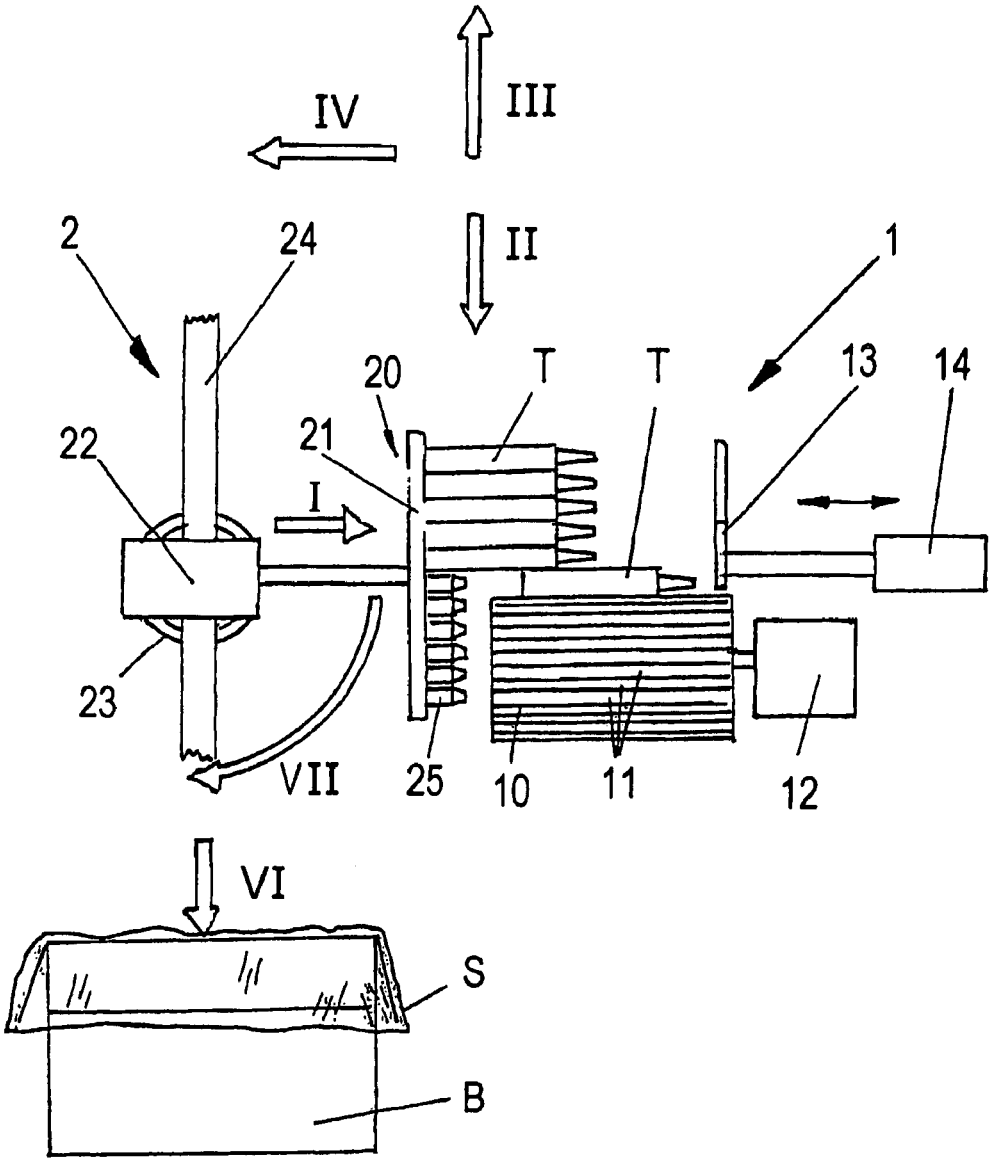
FIG. 1 a schematic arrangement of the device in the region of the transfer of the tubes from a grouping unit in a box.

With the subsequent method and device to be described, tubes T are to be packed from a grouping unit 1 by way of a packing unit 2 into boxes B which are preferably provided with a bag-like plastic lining. This situation is schematically represented in FIG. 1. EP B-1 114 784 is referred to with regard to a more detailed design of the grouping unit. Only the parts of the grouping group which are of interest here are represented in the simplified representation according to FIG. 1. The tubes which are continuously supplied from a production line which is not represented here are deposited onto a transport belt 10 which consists of a multitude of product receivers 11 in the form of semi-shells. The tubes T to be packed are supplied in groups by way of a drive 12, preferably a stepper motor, and by way of a slider 13 which may be actuated by way of a piston-cylinder unit 14, are transferred from a transport belt 10 to a packing unit 2.

The packing unit 2 as an essential element has a mandrel support 20 which comprises a plate 21 which by way of a piston cylinder unit 22 may be moved in the direction of the grouping unit 1 and away from this. The piston-cylinder unit 22 with the mandrel support 20 as a whole may be pivoted with a pivot element 23 by 90° from the horizontal position as is represented in FIG. 1 into the vertical position. Simultaneously, the pivot element 23 together with the piston-cylinder unit 22 and the mandrel support 20 may be moved back and forth, which is represented symbolically by a rod 24 on which all previously described parts of the packing unit 2 may be moved back and forth. The descriptions with regard to the subsequent figures are referred to with respect to a more accurate design of the mandrel support 20 with the plate 21 and the mandrels which are fastened thereon.

The method according to the invention is hereinafter explained again with reference to FIG. 1. The tubes T to be packed which arrive in a continuous manner from a production line which is not shown here, lie in the product receivers 11 on the transport belt 10, and are transported by way of these to a push-off position. The unit number of tubes lying next to one another may be set and the number corresponds exactly to that quantity which corresponds to a layer of tubes to be placed into a box B. If the group of tubes T is located on the transport belt 10 in the correct position, then the slider 13 is activated by way of the piston-cylinder unit 14 and the complete row of tubes T is simultaneously pushed onto the first row of mandrels which are arranged on a mandrel support 20. For this, the plate 21 of the mandrel support 20 was moved by way of the piston-cylinder unit 22 firstly in the direction of the arrow I to the grouping unit 1 and thereafter lowered to the suitable level in the direction of arrow II, so that the already lying group of tubes may all be simultaneously pushed onto the uppermost row of mandrels of the mandrel support 20 by way of the slider 13. After that, the mandrel support 20 is lifted in the direction of arrow III and is then moved somewhat away from the grouping unit 1 in the direction of arrow IV.

Next, a new group of tubes T is again advanced by way of the transport belt 10 into the ejection position, whereupon the mandrel support 20 is again moved in the direction of arrow I to the grouping unit 1, after this is again lowered in the direction of arrow II, and the next layer of tubes is pushed by the slider 13 onto the second row of mandrels, i.e. the second to top row of mandrels. Hereby, the downwards movement is traveled in the arrow direction II downwards only until the already pushed-on layer of tubes lies on the rear free end of the tubes to be pushed on, so that these tubes are guided between the already pushed-on tubes and the product receivers 11 during the displacement. Accordingly, no tilting movement may take place during the push-off. This movement sequence is repeated until the mandrel support 20 is completely loaded (charged) with tubes. After the last row of tubes have been pushed on, the mandrel support is again traveled upwards in the direction of arrow III, and as arrow IV shows, away from the grouping unit 1, whereupon a rotational movement according to arrow VII is then effected, so that now all pushed-on tubes T are held in the vertical direction on the mandrel support 2 with the tube head at the bottom, whereupon this support is lowered in the direction of arrow VI and all tubes are simultaneously pushed into the already standing box B. The tubes T which are located in the box B are all simultaneously pushed off from the mandrel support 20 by way of a pull-off mechanism which is yet to be described, and this mandrel support travels back again into its initial position, whereupon a new cycle begins.

In order to achieve an as compact as possible packing of the tubes in the box, one preferably arranges the mandrels on the mandrel support in each case offset by half a diameter with respect to adjacent rows lying above one another. Accordingly, with regard to the method, the transport belt 10 is stopped offset by half the diameter of the tubes, so that the tubes in turn are aligned exactly onto the mandrels. Thus an as compact as possible arrangement of the tubes in the box B may be achieved with this.

Since in particular such plastic tubes or tubes of laminate with a plastic coating are often applied in the pharmaceuticals industry as well as the foodstuffs industry, accordingly high demands are set with regard to the purity and cleanliness. Since cardboard boxes always contain a certain share of paper dust, one increasingly demands the boxes B themselves to be of plastic or to be provided with a bag-like film lining S. These bag-like film linings S are usually inserted by hand and the edges are put over the flaps of the boxes which are bent laterally down inwardly. A completely correct arrangement of the box with this film lining is hardly possible. This has always led to problems on filling the tubes into such lined boxes. There are various reasons for this. On the one hand such film linings always have a certain static charge and this increases on introduction of the tubes into the box. On the other hand however, until now, the boxes to be filled up were also set up laterally on the [side] edge, and the tubes pushed laterally into the open box directly from the grouping unit 1. Since however the film lining has practically no intrinsic stiffness, accordingly the film always hangs down from the upper side wall. This leads to corresponding problems on introducing the last layer of the tubes. Here the film lining, in practice, is always partly crumpled together and then may be hardly closed. If one attempts to pull smooth the crumpled together film, then the tubes fall out at the same time. With the solution according to the invention, the tubes are placed on the mandrels in an unmovable position. Accordingly, the bag-like film lining may always be pushed directly into the box into the correct end position.

Furthermore, with the method according to the invention, the box stands on its base and accordingly the bag-like film lining hangs relatively correctly in the box. The present forces of the static charging no longer continue to play a significant role. What is essential with regard to the correct packing of the tubes into the boxes B is their exact and adequately firm mounting on the mandrels of the mandrel support 20. The subsequent parts of the description are referred to with regard to this.

Figure 2:
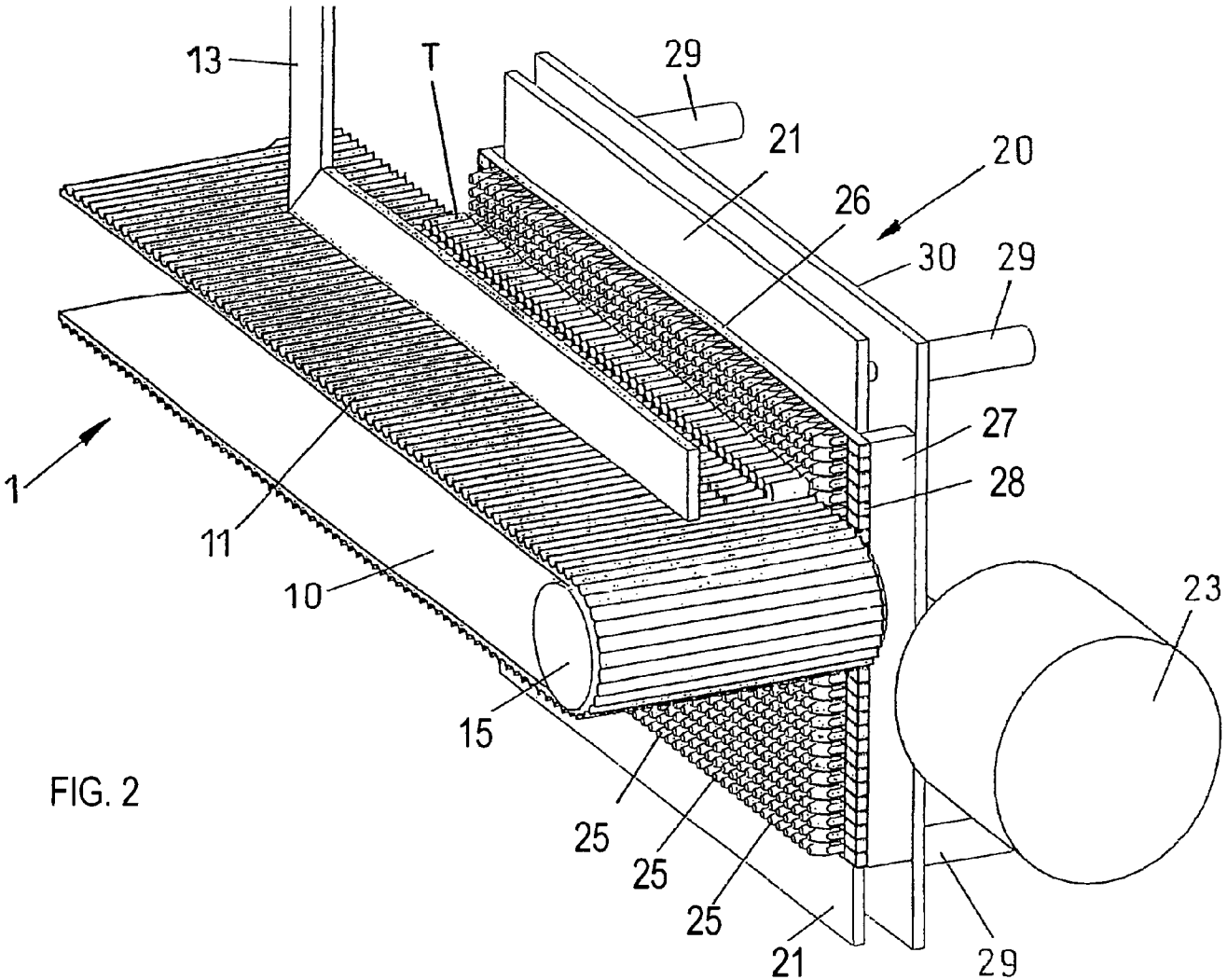
FIG. 2 a perspective representation of a mandrel support, on transfer of the tubes from the grouping unit, FIG. 3 in a schematic lateral view, on dispensing the tubes from the mandrel support into a box.

The mandrel support 20 is represented perceptively in a larger scale in FIG. 2. Again one may recognize a part of the grouping unit 1 consisting of the transport belt 10 with the product receivers 11 in the form of semi-shells. The transport belt 10 runs around a deflection roller 15. One may partly still recognize the angular slider 13. Although in the drawing represented here, the upper three rows of mandrels 25 would already be loaded, these have been omitted for the sake of clarity. One recognizes the supplied group of tubes T which are arranged exactly in the push-on position. The three upper rows of mandrels which would already be loaded with tubes, as a result of this would in the position shown here lie on the group of tubes which lie ready here. In the next step, the slider 13 would then move in the direction towards the plate 21 and would push the group of tubes lying ready, onto the fourth mandrel row from above. This corresponds to exactly the opposite loading sequence of previously known tube packing machines. With this, in each case the tubes are filled from the top to bottom and as a result, the first group of tubes would form the lowermost layer in the box. Here, in contrast the mandrels are supplied with groups of tubes from the top to the bottom.

The actual plate 21 carrying the mandrels is held in a movable manner. A chassis plate 30 is accordingly present through which piston rods of piston-cylinder units 24 pass, and which holds the movable plate 21 carrying the mandrels. The plate 21 carrying the mandrels 25 is provided with suitable bores through which the respective screws engage, and these engage into the rearward end of the mandrels 25. Lateral carrier bars 27 are arranged on the chassis plate 30 along the vertical side edge. Ejection rods 26 are assembled on these lateral carrier bars 27. A distancer 28 in each case is held on both sides between in each case two adjacent ejection rods 26. Accordingly, the ejection rods 26 run parallel and at a distance in each case to two adjacent rows of mandrels 25.

Figure 3:
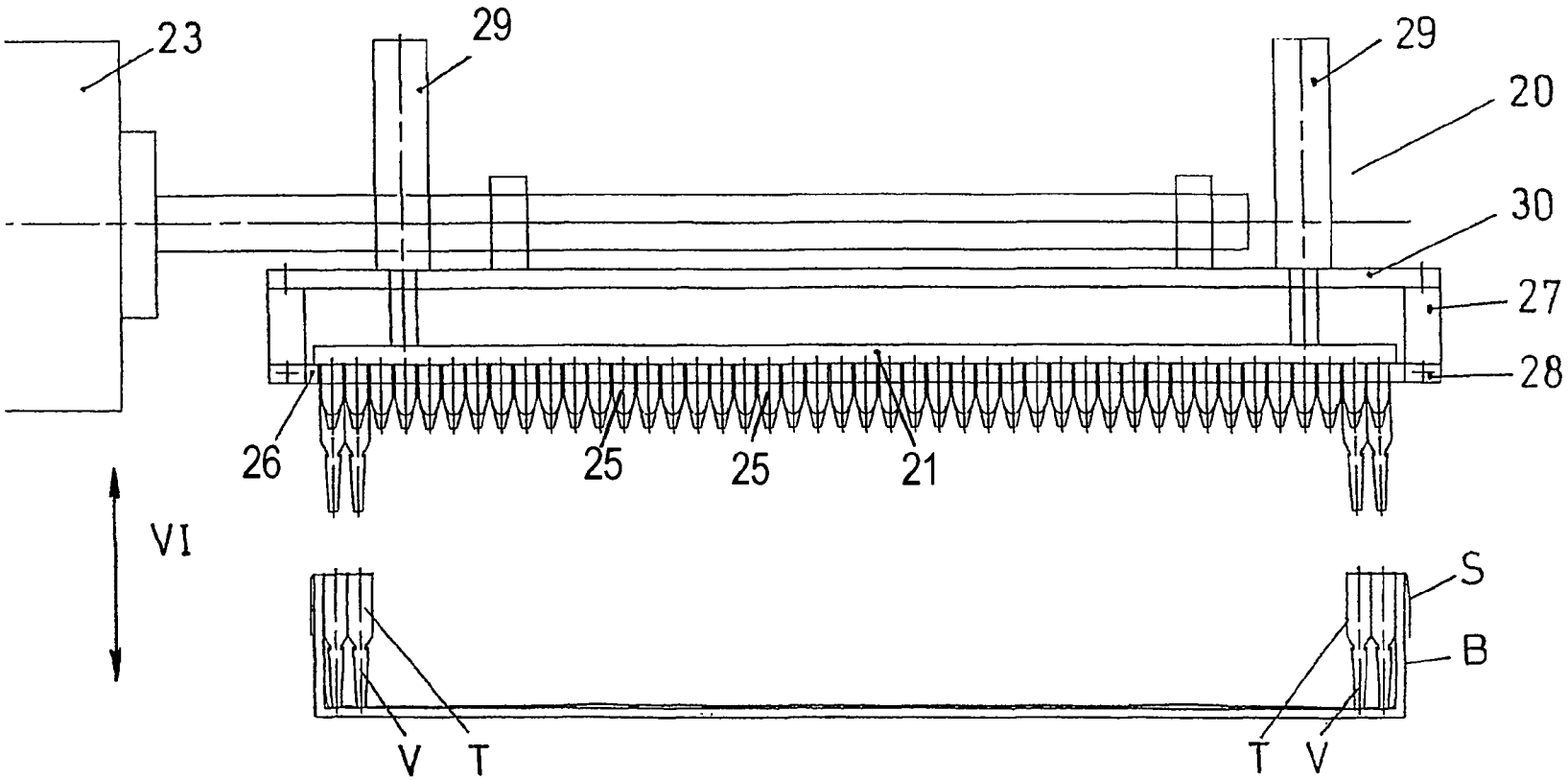
Figure 4:
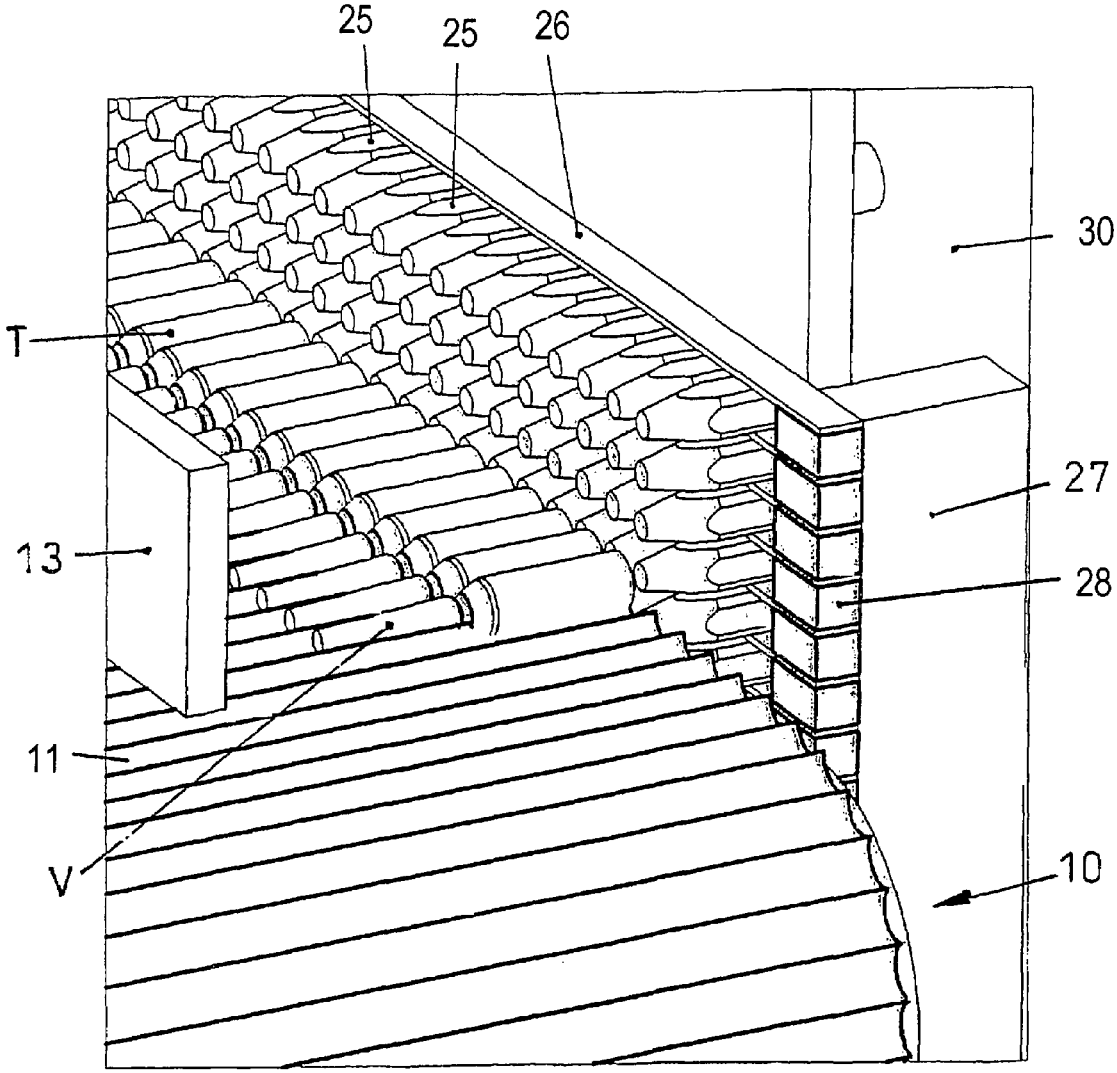
FIG. 4 an enlarged detailed view of FIG. 2.

If all mandrels 25 are loaded with tubes T, the chassis plate 30 with the mandrel-carrying plate 21 and the piston-cylinder units 29 is removed from the grouping unit, is traversed upwards, and is turned by 90° by way of a pivot element 23. Then, as previously mentioned, the complete mandrel support 20 is lowered and the tubes T are moved into the box B, and in this position the plate 21 is then pulled towards the chassis plate 30 by way of the piston-cylinder units 29, wherein simultaneously the ejection rods 26 resting at an unchangeable distance on the lateral carrier bars 27 step into operation and pull the tubes T from the mandrels 25. Thereafter the mandrel supports 20 as a whole are moved again into the initial original position. This situation is represented once again schematically in FIG. 3. Again the box B standing on its base surface with the bag-like film lining S is evident. A few tubes T which have been filled and with their closures V placed thereon are shown filled in the box B, and simultaneously also the mandrel support 20 in the already pulled-off position is represented, in which the mandrel-carrying plate 21 is already advanced into its filling position, so that the mandrels 25 may be loaded again.

Although it is not represented in the figures, one would most preferably arrange the mandrels 25 in the horizontal position in each case offset by half the diameter of the tubes to be filled, in order thus to achieve the most compact as possible packing, by which means it is ensured that the tubes remain in the box unmovable in their position.

Figure 7:
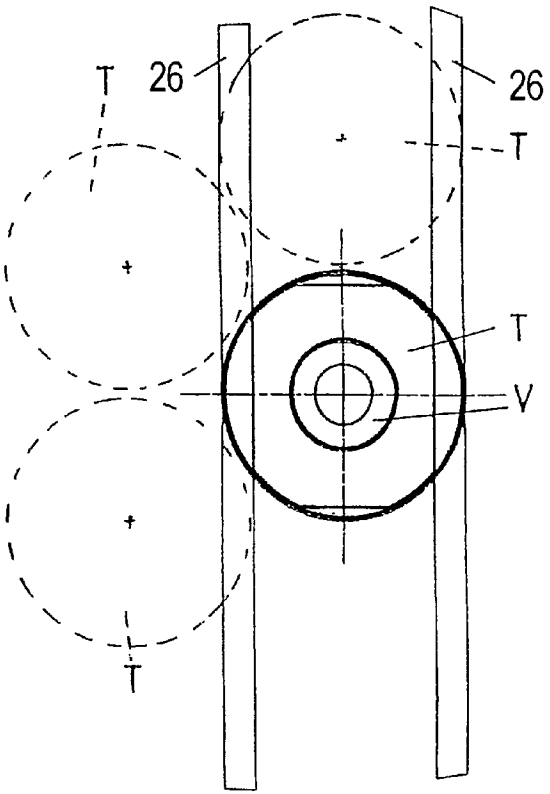
FIG. 7 an individual mandrel with a placed-on tube, in a view perpendicular to the mandrel.
Figure 5:
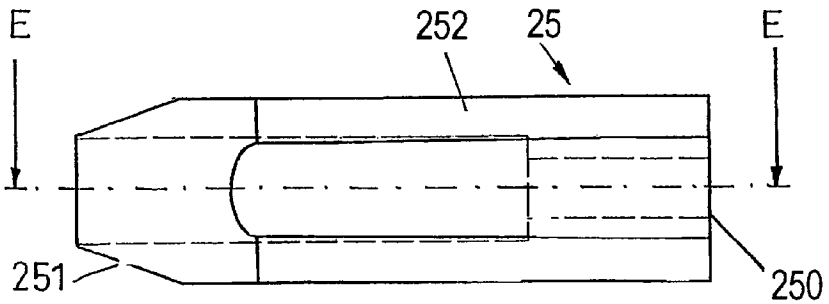
FIG. 5 a individual mandrel in a lateral view.
Figure 6:
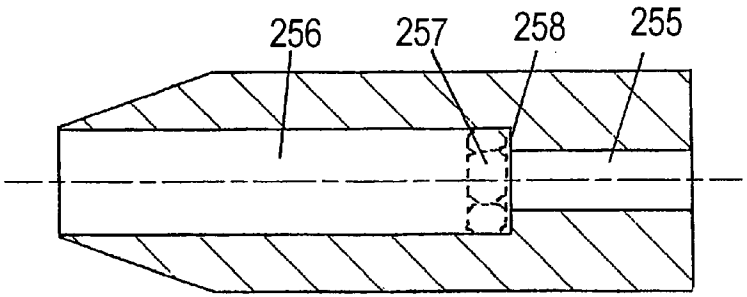

The mandrels 25 are represented in detail in the FIGS. 5 to 7. FIG. 5 here shows a lateral view whilst FIG. 6 represents an axial longitudinal section in the plane E, as is represented drawn in FIG. 5. Each mandrel has an essentially rectangular cross section. The end 250 directed to the plate 21 carrying the mandrels is ground in a plane manner. The oppositely lying free end 251 is ground in a conical manner. The longitudinal edges 252 are rounded according to the inner diameter of the tubes to be accommodated. In total the mandrels 25 are ground with a lower conicity, so that the cross-sectional surface at the end 250 is slightly larger that the cross-sectional surface of the mandrel below the conically ground part. By way of this, it is ensured that the tubes are slightly deformed by pushing on, and thus are held on the mandrels in an elastic manner.

A centric axial bore passes through each mandrel 25. The diameter of this axial bore varies. The axial bore section 255 directed to the end 250 has a smaller diameter. This diameter is slightly larger than the diameter of the fastening screw which engages through the plate 21 into this bore section 255. A bore section 256 with a larger diameter is present at the free end 251 in the direction to the plane end 250. This diameter is designed such that a screw nut 257 may be pressed therein. This may be pressed down to the shoulder 258 which is produced by the change in diameter. The fastening screw with which the mandrel 25 is fastened onto the plate 21 engages into this nut 257.

In FIG. 7, this mandrel 25 may be recognized in the view from above, wherein here however a tube T with the closure V placed on is drawn in the placed-on condition. The individually represented mandrel 25 is arranged between two parallel, adjacent ejection rods 26. The lower, open end of the tube reaches up to practically at least approximately the: upper edges of the ejection rods 26. The adjacent tubes T are drawn in a dashed manner. Here one recognizes that the tubes T of the same row as well as the adjacent tubes T of the subsequent following row lie on the same ejection rod 26. This is possible because the tubes T, as already mentioned, are pushed on, in each case offset by half the diameter. As already mentioned but not shown in the drawing, accordingly also the mandrels 25 of adjacent rows are arranged offset to one another by the corresponding distance.

First trials with a trial arrangement have already shown that thanks to the method according to the invention and the corresponding device, one may not only operate in a particularly more reliable manner compared to known methods, but that additionally one may also achieve an increase in productivity. This however necessitates the mandrel support 20 with the plate 21 and the chassis plate 30 being present with a doubled design. This may be achieved without any problem by way of arranging both mandrel supports next to one another along the transport belt 10 of the grouping unit 1 and accordingly controlling the transport belt such that alternately, firstly a first mandrel support is completely filled and thereafter the second mandrel support. Of course other arrangements of two mandrel supports are also considered.

LIST OF REFERENCE NUMERALS

B box
T tubes

S bag-like film lining
V closures
1 grouping unit
2 packing unit
10 transport belt
11 product receivers in the form of semi-shells
12 drive, stepper motor
13 slider
14 piston-cylinder unit
15 deflection roller
20 mandrel support
21 plate
22 piston-cylinder unit
23 pivot element
24 rod
25 mandrels
26 ejection rods
27 lateral carrier bars
28 distancers
29 piston-cylinder unit
30 chassis plate
33 pivot element
250 plane end
251 free end
252 longitudinal edges
255 axial bore section
256 bore section with larger diameter
257 screw nut
258 shoulder

The invention claimed is:

1. A packing unit for transferring tubes into a container having a clear span, the tubes arriving continuously from a production line and formable into groups of tubes lying next to one another in a settable number by way of a grouping unit, the packing unit comprising:

a mandrel support having a plurality of mandrels arranged in at least two rows thereon, wherein the mandrel support is essentially a plate, which corresponds to the dimensions of the clear span of the container to be filled; and a pull-off element by way of which the tubes can be simultaneously pushed from the plurality of mandrels into said container, wherein the pull-off element is a grate of flat ejection rods structured and arranged in parallel between adjacent rows of mandrels, and wherein the grate can be moved relative to the plate of the mandrel support.

2. A device according to claim 1, wherein each of the plurality of mandrels have the shape of pins which are rectangular in cross section and which are fastened on the plate and whose free ends converge conically in a rounded manner into a blunt tip.

3. A device according to claim 2, wherein each of the plurality of mandrels in the region with a rectangular cross section are rounded on the longitudinal edges.

4. A device according to claim 3, wherein each of the plurality of mandrels in the diagonal dimension are designed reducing in dimension from the plane end on the plate side, to the free ends.

5. A packing unit for transferring tubes into a container having a clear span, the tubes arriving continuously from a production line and formable into groups of tubes lying next to one another in a settable number by way of a grouping unit, the packing unit comprising:

a mandrel support having a plurality of mandrels arranged in at least two rows thereon, wherein the mandrel support is essentially a plate having dimensions that correspond to the clear span of the container to be filled;

a pull-off element by way of which the tubes can be simultaneously pushed from the plurality of mandrels into said container, wherein the pull-off element comprises ejection rods; and distancers that are structured and arranged between adjacent ejection rods, wherein the distancers are held laterally of the mandrel support plate on lateral carrier bars resting on a chassis plate, whilst the mandrel support plate is displaceable relative to the chassis plate so that the tubes can be pushed from the plurality of mandrels simultaneously.

6. A device according to claim 5, wherein each of the plurality of mandrels have the shape of pins which are rectangular in cross section and which are fastened on the plate and whose free ends converge conically in a rounded manner into a blunt tip.

7. A device according to claim 6, wherein each of the plurality of mandrels in the region with a rectangular cross section are rounded on the longitudinal edges.

8. A device according to claim 7, wherein each of the plurality of mandrels in the diagonal dimension are designed reducing in dimension from the plane end on the plate side, to the free ends.

* * * * *